US007084864B1

(12) United States Patent
Wood

(10) Patent No.: US 7,084,864 B1
(45) Date of Patent: Aug. 1, 2006

(54) COMPUTER DISPLAY WITH SWITCHED CAPACITOR POWER SUPPLY

(75) Inventor: Anthony B. Wood, Dallas, TX (US)

(73) Assignee: Texas Instruments Incorporated, Dallas, TX (US)

( * ) Notice: Subject to any disclaimer, the term of this patent is extended or adjusted under 35 U.S.C. 154(b) by 1509 days.

(21) Appl. No.: 08/758,425

(22) Filed: Nov. 29, 1996

(51) Int. Cl.
*G09G 5/00* (2006.01)

(52) U.S. Cl. ..... 345/211; 363/59; 307/110

(58) Field of Classification Search ..... 345/60–63, 345/77, 12, 102, 432, 211, 212, 213, 75, 76, 345/87–88; 363/59, 60; 307/110
See application file for complete search history.

(56) References Cited

U.S. PATENT DOCUMENTS 3,806,829 A * 4/1974 Duston et al. ..... 315/242
4,291,369 A * 9/1981 Hochstrate ..... 363/60
4,321,661 A * 3/1982 Sano ..... 363/60
4,994,953 A * 2/1991 Haak ..... 363/60
5,179,289 A * 1/1993 Sridharan ..... 363/60
5,315,695 A * 5/1994 Saito et al. ..... 345/63
5,398,041 A * 3/1995 Hyatt ..... 345/88
5,461,557 A * 10/1995 Tamagawa ..... 307/110
5,491,623 A * 2/1996 Jansen ..... 363/60
5,510,814 A * 4/1996 Ise ..... 345/211
5,561,597 A * 10/1996 Limpaecher ..... 363/60

* cited by examiner

*Primary Examiner*—Kent Chang
(74) *Attorney, Agent, or Firm*—Ronald O. Neering; Wade James Brady, III; Frederick J. Telecky, Jr.

(57) ABSTRACT

A computer (80) includes a display assembly 10 which uses a backlight power supply 40 to power a fluorescent tube 18 for backlighting purposes. The power supply generates voltages necessary to power the tube 18, generally in the range of 250–450 for steady-state operation, using a bank 41 of switched capacitors 52. The switched capacitors are charged in parallel and switched to a serial configuration to produce the voltage necessary to power the tube 18.

8 Claims, 4 Drawing Sheets

COMPUTER DISPLAY WITH SWITCHED CAPACITOR POWER SUPPLY

BACKGROUND OF THE INVENTION

1. Technical Field

This invention relates in general to computers and, more particularly, to a computer display having a switched capacitor power supply for backlighting.

2. Description of the Related Art

For many years, the popularity of portable computers has risen as the size and weight of the portable computer has been reduced. Early portable computers were known as "luggable" computers, since they could be transported, but were only slightly smaller and lighter than comparable desktop computers. "Laptop" computers were smaller and lighter, but generally had reduced features and flexibility because most of the circuitry needed to be designed into the laptop motherboard without the option of expansion boards.

Notebook computers are significantly smaller and lighter than laptop computers. The desirability of a notebook computer design is based largely upon the size and weight of the notebook computer. Most notebook computer owners are willing to pay a premium for thinner, lighter notebook computers, because a smaller size and lighter weight increases the number of settings in which the computer can be used. It is very desirable, for example, for the computer to fit neatly into a briefcase or attaché along with other work documents.

One area which affects the thickness of a notebook computer is the display assembly. Typically, the display assembly is contained in a housing which is connected to the main housing by a hinge. Accordingly, the thickness of the display housing directly affects the overall thickness of the notebook computer.

The display assembly includes a power source for powering a cold cathode fluorescent tube (also referred to as a CCFL or CCFT), which provides a backlight to illuminate the LCD (liquid crystal display). Present day CCFL power supplies include a transformer (referred to as a DC-to-AC inverter) to boost an available DC voltage from the computer's power supply (typically 5 to 12 volts) to approximately 1000 volts for igniting the CCFL and to 250–450 volts AC for continuous steady-state operation of the CCFL. The output of the power supply is an AC voltage to prevent materials within the CCFL from migrating to the poles of the tube.

Since transformers of the size needed for the required boost are inherently non-flat, they increase the thickness of the display assembly. Further, because of the large gain provided by the transformer, the CCFL power supply operates at a high frequency, typically in the range of 25–100 kHz. This high frequency range can be a source of EMI (electromagnetic interference), both outside to the surrounding environment and to data signals driving the display panel. In particular, interference caused by the transformer operating at high frequency may affect display signals transmitted to the display using LVDS (Low Voltage Differential Signaling), which employs a differential signal having voltages on the order of a few hundred millivolts.

Accordingly, the need has arisen for a low profile power supply which does not use transformers.

SUMMARY OF THE INVENTION

In the present invention, a computer includes processing circuitry and a display. A fluorescent tube generates a light to illuminate the display. The tube is powered by a power source comprising a voltage source and a bank of capacitors switched between a charging mode in which the capacitors are charged in parallel by said voltage source and a discharge mode in which the capacitors are discharged in a series configuration to said tube.

The present invention provides significant advantages over the prior art. First, because the components used in the CCFL power source are relatively flat, as opposed to a transformer, it should significantly reduce the thickness of the display housing. Second, since it can operate a low frequency, it generates less noise. Third, the alternating voltage output should be almost perfectly symmetric thereby eliminating any gradient affects concerning the brightness of the CCFL.

BRIEF DESCRIPTION OF THE DRAWINGS

For a more complete understanding of the present invention, and the advantages thereof, reference is now made to the following descriptions taken in conjunction with the accompanying drawings, in which.

DETAILED DESCRIPTION OF THE PREFERRED EMBODIMENT

The present invention is best understood in relation to FIGS. 1–9 of the drawings, like numerals being used for like elements of the various drawings.

Figure 1:
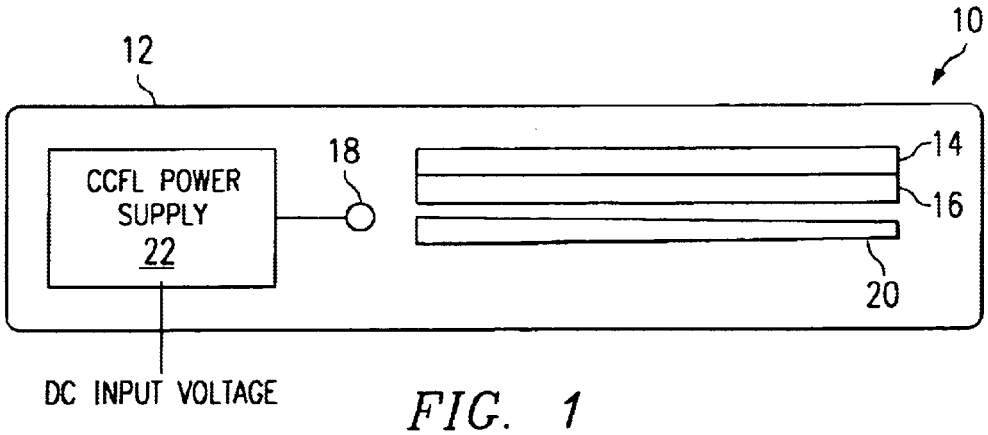
FIG. 1 (PRIOR ART)
FIG. 1 illustrates a block diagram of an embodiment of a prior art LCD display assembly.

FIG. 1 illustrates a cross sectional top view of a LCD display assembly 10 of a type commonly used in notebook computers. A display housing 12 surrounds the components of the display assembly 10, except for the region of the display exposed for viewing. The LCD display assembly 10 includes a color filter 14 and a thin film transistor layer (TFT) 16. All active matrix LCD panels must have a source of backlighting. To illuminate the LCD panel, a CCFL 18 is mounted adjacent a wedge shaped acrylic panel 20. The CCFL is powered by CCFL power supply 22 which receives a DC input voltage.

In operation, the CCFL 18 generates a light which is dispersed through acrylic panel 20, which provides a relatively even light source directly behind the TFT 16. In general, a voltage of about 1000 volts is needed for initial excitation of the gas within the CCFL. Thereafter, a steady-state voltage of about 400–450 volts is sufficient to maintain the illumination. The degree of illumination can be varied by adjusting the steady-state voltage.

The potential between the terminals of the CCFL would result in a migration within the CCFL if a DC (direct current) power supply were used. To reduce migration, an AC voltage is used. Thus, each terminal of the CCFL 18 operates as both anode and cathode.

Figure 2:
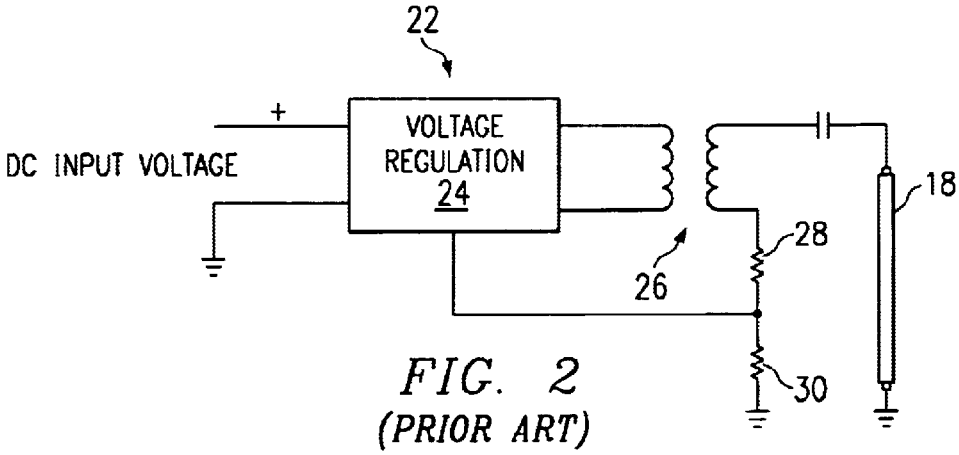
FIG. 2 (PRIOR ART)
FIG. 2 illustrates a schematic diagram of a prior art backlight power supply.

FIG. 2 illustrates a block diagram of the CCFL power supply 22. The primary voltage source, typically on the order of five to twelve volts, is coupled to voltage regulation circuitry 24. Voltage regulation circuitry 24 is coupled across the primary of transformer 26. The secondary of transformer 26 has one terminal coupled to a first terminal of CCFL 18 and its other terminal coupled to ground through resistors 28 and 30, which are typically on the order of a tenth of an ohm. The second terminal of CCFL 18 is also coupled to ground.

In operation, the primary voltage is converted to AC through regulation circuitry 24. The voltage output of regulation circuitry 24 is multiplied by the transformer 26 to power the CCFL 18. When the CCFL 18 illuminates, current flows through resistors 28 and 30, which can be detected by regulation circuitry 24. Once current flow is detected, the voltage output from regulation circuitry 24 can be reduced to provide an output of 400–450 volts from the secondary of transformer 26. The brightness of the illumination of the CCFL 18 can be controlled by the regulation circuitry 24 either through pulse width modulation of the signal or by controlling the voltage to the primary of transformer 26.

The circuit of FIG. 2 has significant problems. First, the transformer is fairly thick, which increases the thickness of the display assembly 10. Second, EMI (electromagnetic interference) is generated by the high frequencies of the circuit, which may pose problems with LVDS LCD interfaces. Third, it is believed that the circuit of FIG. 2 does not evenly alternate the voltage between the terminals of CCFL 18 and, therefore, a light gradient will be formed from top to bottom of CCFL 18, which is distracting to users.

Figure 9:
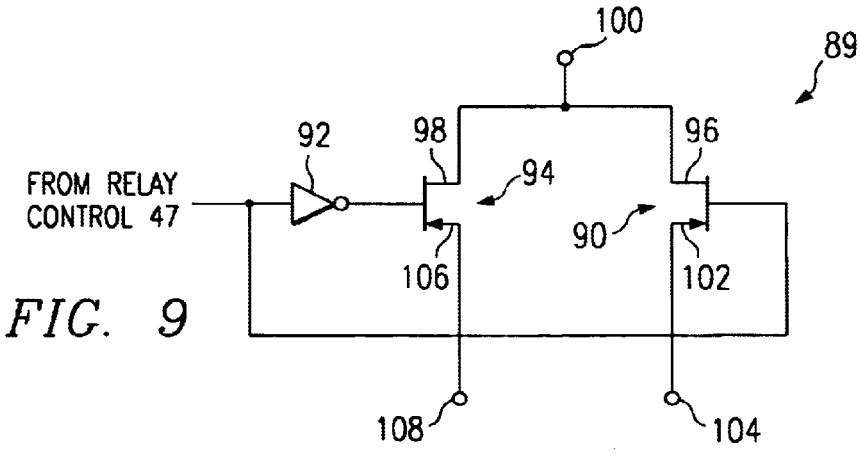
FIG. 9 illustrates single pole double throw relay using high voltage, low power MOSFETs.
Figure 3A:
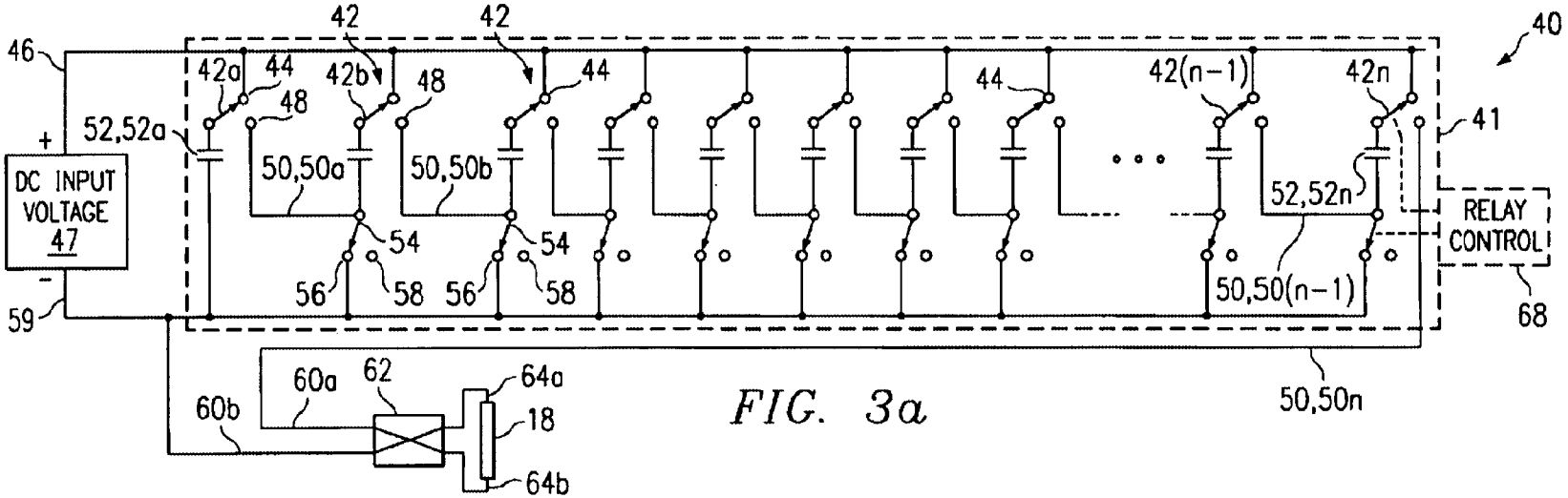
FIGS. 3*a* and 3*b* illustrate schematic diagrams of a backlight power supply using a switched capacitor bank.

FIG. 3*a* shows a schematic representation of a basic circuit 40 incorporating a switched capacitor bank 41 for powering a CCFL which does not use inductors. The switched capacitor bank 41 includes a plurality of single pole, double throw relays 42, each relay being individually labeled 42*a* . . . 42*n*. In the preferred embodiment, the relays are high power, low voltage MOSFETs; an example of such a relay is shown in FIG. 9. Each relay 42 has a first terminal 44 (hereinafter the "charging" terminal) coupled to the positive terminal 46 of a DC power source 47 and a second terminal 48 (hereinafter the "discharge" terminal) coupled to a connecting line 50 (individually referenced as connecting lines 50*a*–50*n*). A plurality of capacitors 52 (each capacitor being individually labeled 52*a* . . . 52*n*) are coupled to respective relays 42, such that the anode of each capacitor 52 is coupled to either the charging terminal 44 or the discharge terminal 48 responsive to the state of the corresponding relay 42.

The cathode of each capacitor 52 is coupled to the connecting line 50 coupled to the discharge terminal 48 of the previous capacitor in the sequence. Hence, the cathode of capacitor 52*b* is coupled to the discharge terminal 48 of relay 42*a* by connecting line 50*a* and the cathode of capacitor 52*c* is coupled to the discharge terminal 48 of relay 42*b* by connecting line 50*b*. The cathode of capacitor 52*a*, the first in the sequence of capacitors, is coupled to ground. The cathode of each capacitor 52, other than capacitor 52*a*, is also connected to a relay 54, which has a charging terminals 56 and discharge terminals 58. The charging terminals 56 are coupled to the negative terminal (ground) 59 of the DC power source 47 and the discharge terminals 58 are floating.

Connecting line 50*n*, the connecting line coupled to the last capacitor 52 in the sequence, is coupled to input 60*a* of cross-connect 62. The negative terminal of the DC power source 47 is coupled to input 60*b* of cross-connect 62. The outputs 64*a* and 64*b* of the cross-connect 60 are coupled to the CCFL 18. The individual relays are controlled through relay control 68. The remaining portions of the display, i.e., the color filter 14, TFT 16 and acrylic panel 20 can be the same as shown in FIG. 1.

The DC power source 47 is typically located external to the display housing, but could be integrated into the display housing 12. In a notebook computer, the DC power source is typically a battery or the output of a AC-to-DC converter plugged into the main computer housing. Within the computer housing, a switching power supply generates several voltages from the power source, typically 3.5 volts, 5 volts and 10–12 volts. Generally, the DC power is fed to the display through power lines disposed through the hinges between the display housing and the main computer housing.

In operation, the relays 42 and 54 synchronously switch between the charging terminals 44 and 56, respectively, and the discharge terminals 48 and 58, respectively. When relays 42 and 54 are coupled to the charging terminals 44 and 56, as shown in FIG. 3*a*, all of the capacitors 52 are coupled in parallel between the positive and negative terminals 46 and 59 of the DC power source 47. Consequently, each capacitor charges itself to the voltage across the terminals of power source 47.

Figure 3B:
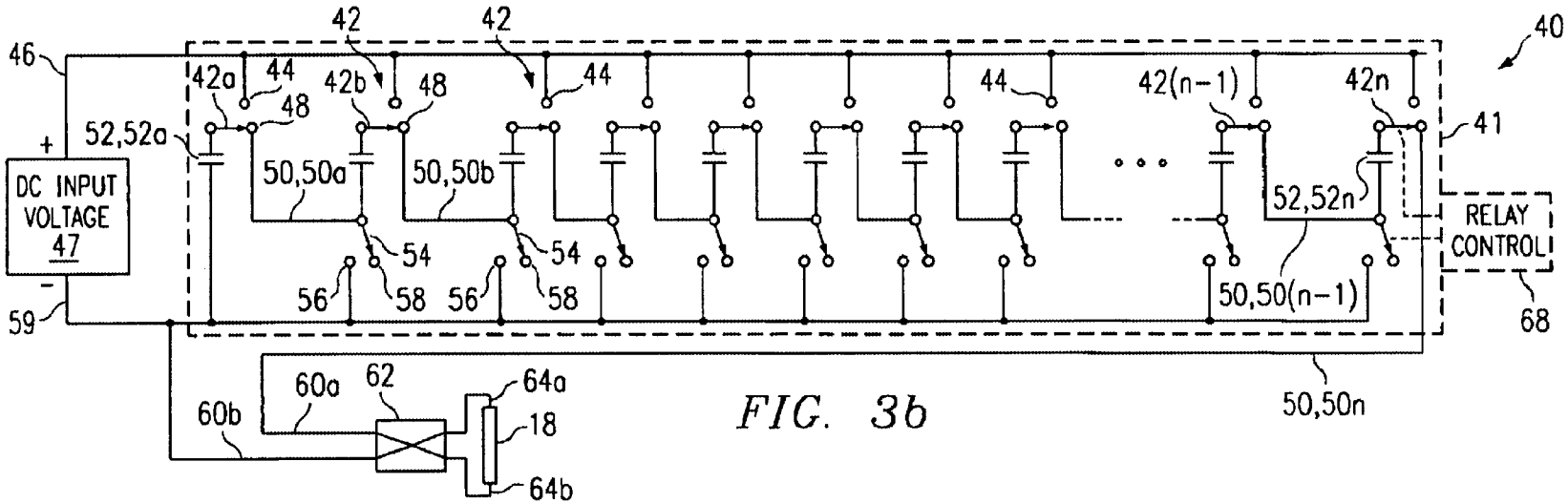

Once the capacitors 52 are charged, the relays 42 and 54 switch to the discharge terminals 48 and 58, respectively, as shown in FIG. 3*b*. In this state, the charged capacitors 52 are aligned in series, with the anode of one capacitor coupled to the cathode of the next capacitor in the sequence. While in series, the voltage across the capacitors is additive; therefore if there are forty capacitors 52, each charged to ten volts, there is a voltage of 400 volts when the relays 42 and 54 have aligned the capacitors in a serial path.

The cross connect switch 62 reverses the polarity of its outputs on every discharge cycle. Therefore, if input 60*a* is coupled to output 64*a* and input 60*b* is coupled to output 64*b* through cross-connect 62 on a first cycle, then input 60*a* will be coupled to output 64*b* and input 60*b* will be coupled to output 64*a* through cross-connect 62 on the next cycle.

Accordingly, by charging capacitors 52 in parallel, aligning the capacitors 52 in series and discharging the aligned capacitors 52 through the cross connect 62, alternating pulses of high voltage can be delivered to the CCFL 18.

The backlight power supply 40 can operate at any frequency. However, powering the backlight at frequencies less than 60 Hz is perceptible by the human eye.

Figure 4:
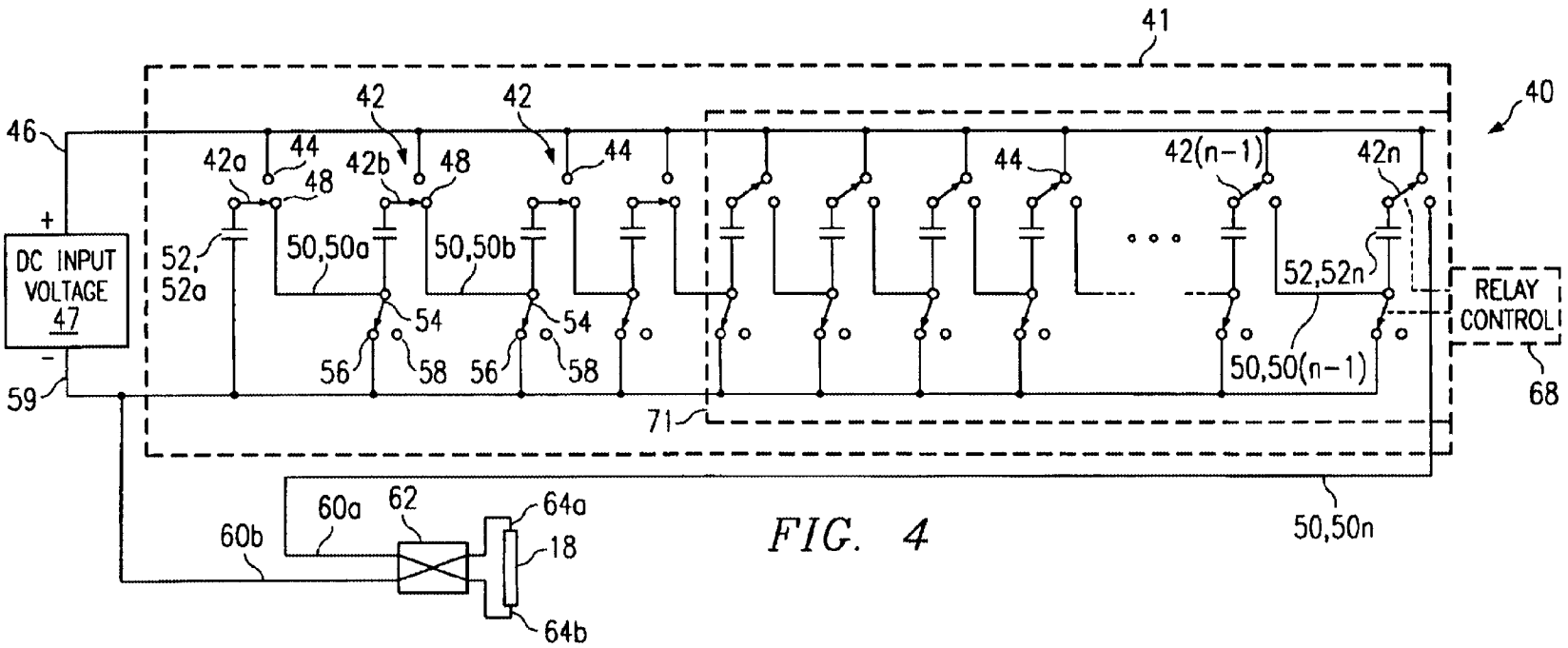
FIG. 4 illustrates an embodiment of a backlight power supply operable to provide an initial excitation voltage and a steady-state voltage through the switched capacitor bank.

As described above, it is necessary to provide a high voltage to initiate current flow through the CCFL. In one embodiment, shown in FIG. 4, there are sufficient capacitors 52 to generate a voltage of approximately 1000 volts when charged by the DC power source 47 (as shown in FIG. 3*a* with all capacitors 52 coupled to the charging nodes 44 and 56) and switched to a parallel configuration. Once the CCFL 18 is excited, a photodiode 70, or other device or circuit for detecting the start, signals the relay control 68, which then sets the relays such that only a subset 71 of the capacitors are charged during subsequent charging cycles (as shown in FIG. 4). Accordingly, when switched to a serial configuration (as shown in FIG. 3*b*), a steady-state voltage can be achieved.

For example, assuming a ten volt input from the DC power source 47, one hundred capacitors 52 would be required to generate 1000 volts for start up purposes. Once the photodiode 70 detected light from the CCFL 18, relay control 68 would set the relays 42 of sixty of the capacitors 52 to the discharge terminal 48. Therefore, on subsequent charging cycles, only the remaining forty capacitors 52 would charge, resulting in a output voltage of 400 volts on the next discharge cycle. Further adjustments to the voltage, for brightness purposes, could be made by increasing or decreasing the number of capacitors which are charged on each cycle or by adjusting the magnitude of DC voltage used to charge the capacitors 52.

To efficiently use all of the capacitors 52, two (or more) banks could be as described above. For start up purposes, the capacitors in the two banks would discharge in serial. For steady state operation, where a greater current is required, the two banks would discharge in parallel, which would provide the needed current.

Figure 5:
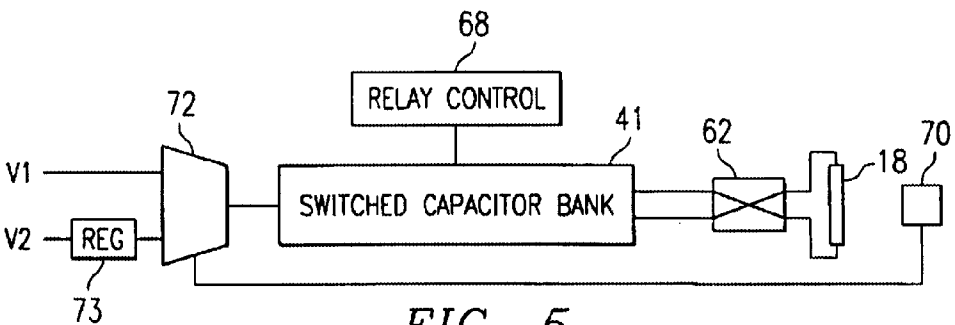
FIG. 5 illustrates an embodiment of a backlight power supply using switched voltages to provide the initial excitation voltage and the steady-state voltage.

A second embodiment for exciting the CCFL 18 is shown in FIG. 5. In this embodiment, the DC input voltage switches between receives two voltages, V1 and V2, from the computer's power supply. Assuming the availability of a ten volt source (V1) and a four volt source (V2), a switch 72 provides the switched capacitor bank 41 with the ten volt source during start-up and the four volt source for steady-state operation. Adjustments to the brightness can be accomplished using an adjustable voltage regulator 73 coupled to the four volt supply.

It should be noted that while the circuit of FIG. 5 uses ten volt and four volt sources, the number of capacitors in the capacitor bank 41 could be varied to accommodate different voltages as well.

Figure 6:
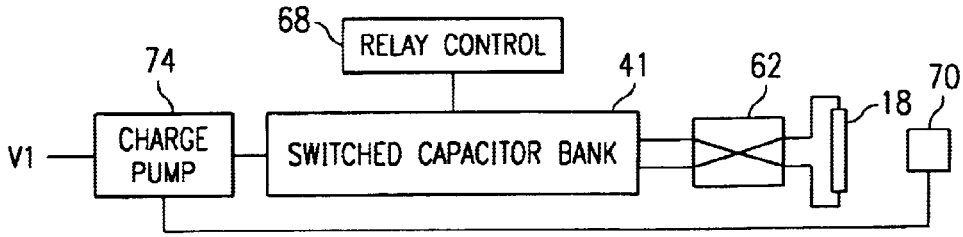
FIG. 6 illustrates an embodiment of a backlight power supply using a charge pump to provide first and second voltages to generate the initial excitation voltage and the steady-state voltage.

FIG. 6 illustrates a variation on FIG. 5, where a single voltage is received from the main computer power supply. A charge pump 74 (which could comprise a second bank of switched capacitors coupled between the voltage source from the main computer and first bank 41 of switched capacitors) provides an enhanced voltage during start-up. Once excitation of the CCFL 18 is detected, the charge pump 74 could be bypassed or set to a lower appropriate voltage.

As an example, in one embodiment of the circuit of FIG. 6, a ten volt DC supply could be increased to a DC voltage of fifty volts by the charge pump 74 during the start-up phase. A bank of twenty switched capacitors 52 could be used to supply the 1000 volt start up voltage. After light was detected from the CCFL, the charge pump could reduce its output voltage to twenty volts, which would result in a steady-state output of 400 volts.

Alternatively, a ten volt DC supply could be increased to a DC voltage of twenty five volts by the charge pump 74 during the start-up phase. A bank of forty switched capacitors 52 could be used to supply the 1000 volt start up voltage. After light was detected from the CCFL, the charge pump could be bypassed, which would result in a steady-state output of 400 volts.

Figure 7:
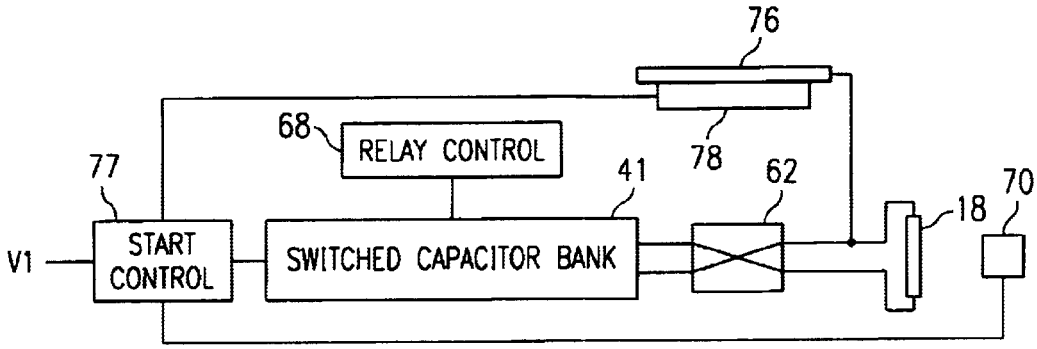
FIG. 7 illustrates an embodiment of a backlight power supply using a external excitation source to generate the initial excitation voltage and the steady-state voltage.

FIG. 7 provides a fourth embodiment of circuitry for providing a start-up voltage to the CCFL, wherein a piezoelectric material strip 76 is mounted on a speaker coil 78 (or other vibration source) and connected to the CCFL in parallel with the output of switch 62. When the backlight is enabled, start-up circuitry 77 applies a voltage to speaker coil 78 causing it to oscillate. As the piezoelectric strip oscillates with the speaker coil 78, it generates a high voltage of 1000 volts. Once excitation was detected, for example by the photodiode 70 of FIG. 4, the speaker coil 78 would be disabled.

Figure 8:
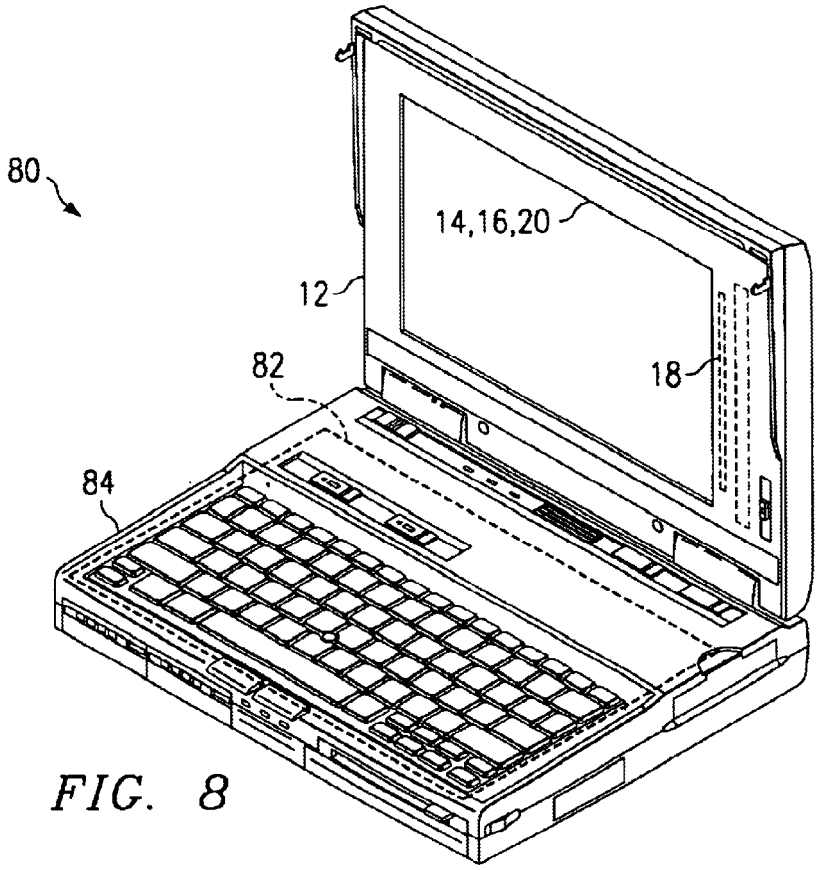
FIG. 8 illustrates a perspective view of a notebook computer incorporating the backlight power supply.

FIG. 8 illustrates a perspective view of a notebook computer 80 including the main processing assembly 82 and the display assembly 84. The main processing assembly 82 contains the keyboard 86, the core processing circuitry 88 (including the central processing unit, memory, video controller, input/output circuitry), mass storage 90 and other peripheral devices. The display assembly 84 contains the color filter 14, TFT 16 and acrylic panel 20 and CCFL 18 shown in FIG. 1 along with the CCFL power source 40.

The CCFL power source 40 could use discrete components or partially or wholly formed on one or more integrated circuits. If discrete components are used, the capacitors could be spread out around the periphery of the display housing 12 in order to take advantage of unused space in the display housing. In general, the capacitors 52 can be placed anywhere within the display assembly 84 which has available room.

FIG. 9 illustrates a schematic of a single pole double throw relay 89 which could be used for relays 42 and 54. An input from relay control 47 is couple to the gate of MOSFET 90 and to an inverter 92. The output of inverter 92 is coupled to the gate of MOSFET 94. A first source/drain 96 of MOSFET 90 and a first source/drain 98 of MOSFET 94 is couple to node 100, which is coupled to the capacitor. The second source/drain 102 of MOSFET 90 is coupled to node 104. The second source/drain 106 of MOSFET 94 is coupled to node 108.

In operation, if relay control 47 outputs a logical high voltage to the relay 89, MOSFET 90 will conduct between nodes 100 and 104, and MOSFET 94 will be at a high impedance. If relay control outputs a logical low voltage to relay 89, MOSFET 94 will conduct between nodes 100 and 108, and MOSFET 90 will be at a high impedance.

The present invention provides significant advantages over the prior art. First, because the components used in the CCFL power source 40 are relatively flat, as opposed to a transformer, it should significantly reduce the thickness of the display assembly 84. Second, since it can operate a low frequency, it generates less noise. Third, the alternating voltage output should be almost perfectly symmetric with respect to a common ground, thereby eliminating any gradient affects concerning the brightness of the CCFL 18.

Although the Detailed Description of the invention has been directed to certain exemplary embodiments, various modifications of these embodiments, as well as alternative embodiments, will be suggested to those skilled in the art. The invention encompasses any modifications or alternative embodiments that fall within the scope of the claims.

What is claimed is:

1. A computer comprising:

processing circuitry;

a display coupled to said processing circuitry;

a fluorescent tube for generating a light to illuminate said display; and a power source coupled to said fluorescent tube, comprising:

a voltage source;

a bank of capacitors switched between a charging mode in which the capacitors are charged in parallel by said voltage source and a discharge mode in which the capacitors are discharged in a series configuration; and circuitry for providing an excitation voltage comprises a strip of piezo-electric material coupled to said tube, wherein said circuitry for providing an excitation voltage comprises a charge pump for generating a predetermined voltage from the voltage source.

2. The computer of claim 1 wherein said bank of capacitors comprises:

a plurality of capacitors;

a plurality of first relays coupled to first nodes of respective capacitors for switching between a first charging node coupled to said voltage source and a discharge node coupled to another capacitor; and a plurality of second relays coupled to second nodes of respective capacitors selectively coupling the second node to said voltage source.

3. The computer of claim 1 wherein said circuitry for providing an excitation voltage comprises a charge pump for generating a predetermined voltage from the voltage source.

4. The computer of claim 1 wherein said circuitry for providing an excitation voltage comprises a switch for selectively providing two or more voltages to said capacitor bank.

5. The computer of claim 2 and further comprising circuitry for controlling said relays.

6. The computer of claim 1 and further comprising a cross-connect switch for alternating the polarity of the output of said power source.

7. The computer of claim 1, wherein all of said capacitors are charged during initial excitation of the fluorescent tube and thereafter a subset of said capacitors are charged during subsequent charging cycles.

8. The computer of claim 1, wherein said voltage source switches between a first voltage source for start-up operation of the fluorescent tube and a second voltage source for steady-state operation of the fluorescent tube.

* * * * *